US008867942B2

(12) United States Patent
Ikeda et al.

(10) Patent No.: US 8,867,942 B2
(45) Date of Patent: Oct. 21, 2014

(54) LEVER SWITCHER WITH MECHANISM FOR MINIMIZING MECHANICAL SHOCK AND SOUND AND FIXING DEVICE AND IMAGE FORMING APPARATUS INCORPORATING LEVER SWITCHER

(75) Inventors: Tamotsu Ikeda, Osaka (JP); Kohta Sakaya, Hyogo (JP); Yoshiharu Takahashi, Osaka (JP); Chikara Hiraoka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 187 days.

(21) Appl. No.: 13/471,935

(22) Filed: May 15, 2012

(65) Prior Publication Data

US 2013/0004217 A1 Jan. 3, 2013

(30) Foreign Application Priority Data

Jun. 28, 2011 (JP) ..... 2011-143300

(51) Int. Cl.
*G03G 15/20* (2006.01)

(52) U.S. Cl.
CPC ..... *G03G 15/2089* (2013.01); *G03G 15/2032* (2013.01)
USPC ..... 399/67; 399/328

(58) Field of Classification Search
CPC ..... G03G 15/2064
USPC ..... 399/67, 328
See application file for complete search history.

(56) References Cited

U.S. PATENT DOCUMENTS 4,492,394 A * 1/1985 Dignan ..... 292/64
5,251,877 A * 10/1993 Rempinski et al. ..... 254/323
6,631,252 B2 * 10/2003 Ando et al. ..... 399/328
7,664,415 B2 * 2/2010 Mikutsu ..... 399/67
7,668,494 B2 * 2/2010 Kubo et al. ..... 399/328
7,769,322 B2 * 8/2010 Ishihara et al. ..... 399/125
8,090,303 B2 1/2012 Hayashi et al.

(Continued)

FOREIGN PATENT DOCUMENTS

CN 101614990 A 12/2009
CN 101794105 A 8/2010

(Continued)

OTHER PUBLICATIONS

Chinese Office Action issued Nov. 5, 2013, in China Patent Application No. 201210211296.2.

(Continued)

*Primary Examiner* — Sandra Brase
(74) *Attorney, Agent, or Firm* — Oblon, Spivak, McClelland, Maier & Neustadt, L.L.P.

(57) ABSTRACT

A fixing device includes a first opposed body and a second opposed body pressed against the first opposed body. A resilient member exerts a resilient bias to the second opposed body that presses the second opposed body against the first opposed body. A lever assembly is swingable to move the second opposed body against the resilient bias exerted by the resilient member between at least a reduced pressure position where the second opposed body presses against the first opposed body with reduced pressure therebetween and an enhanced pressure position where the second opposed body presses against the first opposed body with enhanced pressure therebetween. A resistance applier engages the lever assembly to exert drag on the lever assembly when the lever assembly moves the second opposed body from the reduced pressure position to the enhanced pressure position.

20 Claims, 9 Drawing Sheets

(56) References Cited

U.S. PATENT DOCUMENTS

| | | | | |
|---|---|---|---|---|
| 8,107,864 | B2 | 1/2012 | Saito et al. | |
| 2007/0019978 | A1* | 1/2007 | Kim | 399/67 |
| 2008/0310895 | A1* | 12/2008 | Masuda et al. | 399/331 |
| 2009/0129836 | A1 | 5/2009 | Sakaya et al. | |
| 2009/0190949 | A1 | 7/2009 | Hamahashi et al. | |
| 2010/0034548 | A1 | 2/2010 | Naitoh et al. | |
| 2010/0086334 | A1 | 4/2010 | Sakaya | |
| 2010/0189478 | A1* | 7/2010 | Takahashi | 399/331 |
| 2010/0239297 | A1 | 9/2010 | Sakaya et al. | |
| 2010/0260524 | A1 | 10/2010 | Hiraoka et al. | |
| 2011/0188874 | A1 | 8/2011 | Takahashi et al. | |
| 2012/0002997 | A1 | 1/2012 | Hiraoka et al. | |
| 2012/0020681 | A1 | 1/2012 | Naitoh et al. | |
| 2012/0045241 | A1 | 2/2012 | Takahashi et al. | |

FOREIGN PATENT DOCUMENTS

| | | |
|---|---|---|
| JP | 8-272191 | 10/1996 |
| JP | 11-190410 | 7/1999 |
| JP | 2000-214718 | 8/2000 |
| JP | 2007-298616 | 11/2007 |
| JP | 2011-048061 A | 3/2011 |

OTHER PUBLICATIONS

Office Action issued Jul. 3, 2014 in Chinese Patent Application No. 201210211296.2.

* cited by examiner

LEVER SWITCHER WITH MECHANISM FOR MINIMIZING MECHANICAL SHOCK AND SOUND AND FIXING DEVICE AND IMAGE FORMING APPARATUS INCORPORATING LEVER SWITCHER

CROSS-REFERENCE TO RELATED APPLICATION

This patent application is based on and claims priority pursuant to 35 U.S.C. §119 to Japanese Patent Application No. 2011-143300, filed on Jun. 28, 2011, in the Japanese Patent Office, the entire disclosure of which is hereby incorporated by reference herein.

FIELD OF THE INVENTION

Exemplary aspects of the present invention relate to a lever switcher, a fixing device, and an image forming apparatus, and more particularly, to a lever switcher for changing pressure between opposed bodies, a fixing device incorporating the lever switcher, and an image forming apparatus incorporating the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

FIGS. 1 and 2 illustrate a fixing device 1R installed in such image forming apparatuses, which includes a fixing roller 101 and an opposed pressing roller 102 that apply heat and pressure to a recording medium P bearing a toner image. For example, the pressing roller 102 is pressed against the fixing roller 101 heated by a heater 106 disposed inside the fixing roller 101 to form a fixing nip N therebetween through which the recording medium P bearing the toner image is conveyed. As the fixing roller 101 and the pressing roller 102 rotate and convey the recording medium P through the fixing nip N in a recording medium conveyance direction F, the fixing roller 101 and the pressing roller 102 apply heat and pressure to the recording medium P, melting and fixing the toner image on the recording medium P.

Pressure applied between the pressing roller 102 and the fixing roller 101 is adjustable according to the type of the recording medium P in order to accommodate envelopes produced by bonding a folded sheet, which are susceptible to warping and creasing when passing through the fixing nip N. For example, as shown in FIG. 1, when plain paper is used as a recording medium P, the pressing roller 102 presses against the fixing roller 101 with enhanced pressure, thus forming a longer fixing nip N in the recording medium conveyance direction F, to apply sufficient heat and pressure to the plain paper. Conversely, as shown in FIG. 2, when an envelope is used as a recording medium P, the pressing roller 102 presses against the fixing roller 101 with reduced pressure, thus forming a shorter fixing nip N in the recording medium conveyance direction F to prevent creasing of the envelope.

As a mechanism for changing the pressure between the pressing roller 102 and the fixing roller 101, a configuration may be employed in which a lever 115 moves a pressing frame 111 mounting the pressing roller 102 with respect to a fixing frame 110 mounting the fixing roller 101 by leverage, as shown in FIGS. 3 and 4. For example, a spring presses the pressing frame 111 against the fixing frame 110 to press the pressing roller 102 against the fixing roller 101. As the lever 115 pivotably attached to the pressing frame 111 swings in a direction A1 (clockwise) about a shaft 116 from an enhanced pressure position shown in FIG. 3 where the pressing roller 102 presses against the fixing roller 101 with enhanced pressure to a reduced pressure position shown in FIG. 4 where the pressing roller 102 presses against the fixing roller 101 with reduced pressure, one end of the lever 115, that is, a point of load, contacts the fixing frame 110 as shown in FIG. 4, thereby swinging the pressing frame 111 in a direction B1 about a shaft 103. Accordingly, the pressing roller 102 moves away from the fixing roller 101, producing the shorter fixing nip N through which an envelope P2 is conveyed. Conversely, as the lever 115 swings in a direction A2 (counterclockwise) from the reduced pressure position shown in FIG. 4 to the enhanced pressure position shown in FIG. 3, the one end of the lever 115 no longer presses against the fixing frame 110, thereby swinging the pressing frame 111 in a direction B2 and recovering the longer fixing nip N through which plain paper P1 is conveyed.

However, the configuration shown in FIGS. 3 and 4 has a drawback in that the single lever 115 may restrict movement of the pressing roller 102 apart from the fixing roller 101 or require a substantial force to move the pressing roller 102 apart from the fixing roller 101 farther. Additionally, a resilient bias exerted by the spring to press the pressing frame 111 against the fixing frame 110 may accelerate swinging of the lever 115 in the direction B2. Accordingly, when the lever 115 swings in the direction B2 from the reduced pressure position shown in FIG. 4 to the enhanced pressure position shown in FIG. 3, a substantial mechanical shock is generated and transmitted to the components connected to the lever 115, producing sound and degrading precise formation of the fixing nip N.

To address the above-described drawbacks of the fixing device 1R, it is possible to include a cam that engages and disengages a lever as the lever slides over the outer circumferential edge face of the cam, thus eliminating a strike of the lever against the cam that may generate noise. However, this configuration may not minimize mechanical shock caused by the lever.

Alternatively, a movable cushion or sponge that contacts the lever to absorb mechanical shock therefrom can be employed. However, an expensive solenoid may be required to separate the cushion from the lever, resulting in increased manufacturing costs.

SUMMARY OF THE INVENTION

This specification describes below an improved lever switcher. In one exemplary embodiment of the present invention, the lever switcher includes a first opposed body and a second opposed body pressed against the first opposed body. A resilient member is connected to the second opposed body to exert a resilient bias to the second opposed body that presses the second opposed body against the first opposed body. A lever assembly is connected to the second opposed body and swingable to move the second opposed body against the resilient bias exerted by the resilient member between at least a reduced pressure position where the second opposed body presses against the first opposed body with reduced pressure therebetween and an enhanced pressure position where the second opposed body presses against the first opposed body with enhanced pressure therebetween. A resistance applier engages the lever assembly to exert drag on the lever assembly when the lever assembly moves the second opposed body from the reduced pressure position to the enhanced pressure position.

This specification further describes an improved fixing device. In one exemplary embodiment, the fixing device includes a fixing rotary body, a heater disposed opposite the fixing rotary body to heat the fixing rotary body, and a pressing rotary body pressed against the fixing rotary body to form a fixing nip therebetween through which a recording medium bearing a toner image is conveyed. A resilient member is connected to the pressing rotary body to exert a resilient bias to the pressing rotary body that presses the pressing rotary body against the fixing rotary body. A lever assembly is connected to the pressing rotary body and swingable to move the pressing rotary body against the resilient bias exerted by the resilient member between at least a reduced pressure position where the pressing rotary body presses against the fixing rotary body with reduced pressure therebetween and an enhanced pressure position where the pressing rotary body presses against the fixing rotary body with enhanced pressure therebetween. A resistance applier engages the lever assembly to exert drag on the lever assembly when the lever assembly moves the pressing rotary body from the reduced pressure position to the enhanced pressure position.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
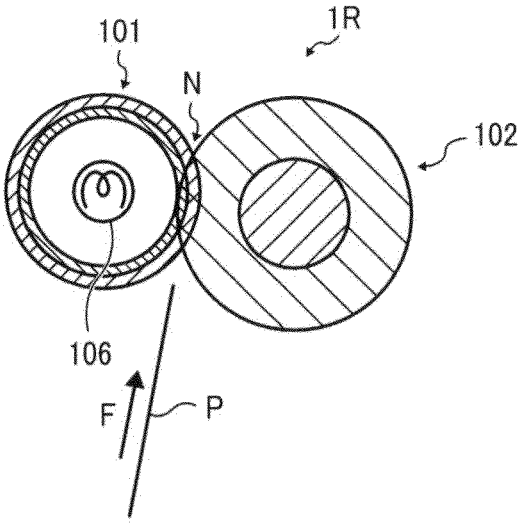
FIG. 1 RELATED ART
FIG. 1 is a schematic vertical sectional view of a related-art fixing device in an enhanced pressure state in which a pressing roller presses against a fixing roller with enhanced pressure therebetween.
Figure 2:
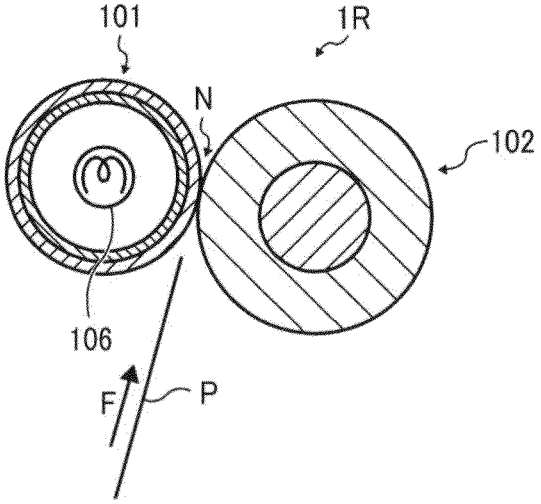
FIG. 2 RELATED ART
FIG. 2 is a schematic vertical sectional view of the related-art fixing device shown in FIG. 1 in a reduced pressure state in which the pressing roller presses against the fixing roller with reduced pressure therebetween.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 5:
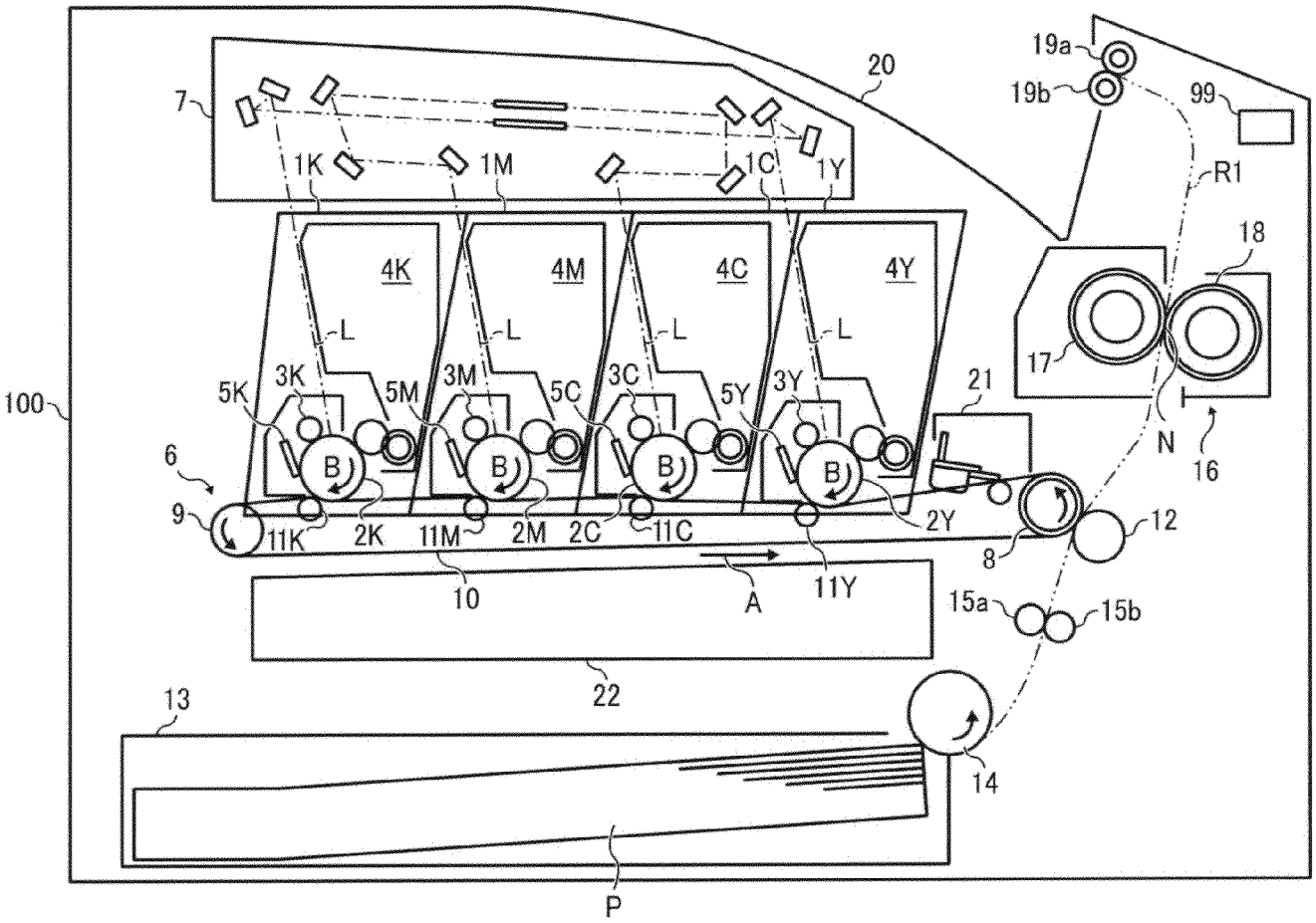
FIG. 5 is a schematic vertical sectional view of an image forming apparatus according to an exemplary embodiment of the present invention.

Referring now to the drawings, wherein like reference numerals designate identical or corresponding parts throughout the several views, in particular to FIG. 5, an image forming apparatus 100 according to an exemplary embodiment of the present invention is explained.

FIG. 5 is a schematic vertical sectional view of the image forming apparatus 100. The image forming apparatus 100 may be a copier, a facsimile machine, a printer, a multifunction printer having at least one of copying, printing, scanning, plotter, and facsimile functions, or the like. According to this exemplary embodiment, the image forming apparatus 100 is a printer for forming color and monochrome toner images on a recording medium by electrophotography.

Referring to FIG. 5, the following describes the structure of the image forming apparatus 100.

The image forming apparatus 100 includes four process units 1Y, 1C, 1M, and 1K detachably attached to the image forming apparatus 100. Although the process units 1Y, 1C, 1M, and 1K contain yellow, cyan, magenta, and black toners that form yellow, cyan, magenta, and black toner images, respectively, resulting in a color toner image, they have an identical structure. Hence, the following describes the structure of one of them, that is, the process unit 1Y that forms a yellow toner image.

The process unit 1Y includes a photoconductor 2Y serving as an image carrier that carries an electrostatic latent image and a resultant yellow toner image; a charging roller 3Y serving as a charger that charges an outer circumferential surface of the photoconductor 2Y; a development device 4Y serving as a development unit that visualizes the electrostatic latent image formed on the outer circumferential surface of the photoconductor 2Y into a yellow toner image with yellow toner; and a cleaning blade 5Y serving as a cleaner that cleans the outer circumferential surface of the photoconductor 2Y.

Above the process units 1Y, 1C, 1M, and 1K is an exposure device 7 serving as an exposure unit that emits a laser beam L onto the outer circumferential surface of the respective photoconductors 2Y, 2C, 2M, and 2K to form an electrostatic latent image thereon.

Below the process units 1Y, 1C, 1M, and 1K is an intermediate transfer unit 6 that accommodates an endless intermediate transfer belt 10, a driving roller 8, a driven roller 9, four primary transfer rollers 11Y, 11C, 11M, and 11K, a secondary transfer roller 12, and a belt cleaner 21. Specifically, the endless intermediate transfer belt 10 is stretched over the driving roller 8 and the driven roller 9 and rotatable in a rotation direction A.

Inside a loop formed by the intermediate transfer belt 10 are the four primary transfer rollers 11Y, 11C, 11M, and 11K serving as primary transferors that transfer the yellow, cyan, magenta, and black toner images formed on the photoconductors 2Y, 2C, 2M, and 2K onto an outer circumferential surface of the intermediate transfer belt 10. The primary transfer rollers 11Y, 11C, 11M, and 11K contact an inner circumferential surface of the intermediate transfer belt 10 and press the intermediate transfer belt 10 against the photoconductors 2Y, 2C, 2M, and 2K at opposed positions where the primary transfer rollers 11Y, 11C, 11M, and 11K are disposed opposite the photoconductors 2Y, 2C, 2M, and 2K, respectively, via the intermediate transfer belt 10. Accordingly, the photoconductors 2Y, 2C, 2M, and 2K press against the outer circumferential surface of the intermediate transfer belt 10, forming primary transfer nips therebetween where the yellow, cyan, magenta, and black toner images formed on the photoconductors 2Y, 2C, 2M, and 2K are primarily transferred onto the intermediate transfer belt 10 to form a color toner image thereon.

Opposite the driving roller 8 is the secondary transfer roller 12 serving as a secondary transferor that transfers the color toner image formed on the intermediate transfer belt 10 onto a recording medium P. The secondary transfer roller 12 contacts the outer circumferential surface of the intermediate transfer belt 10 and presses the intermediate transfer belt 10 against the driving roller 8, thus forming a secondary transfer nip where the color toner image formed on the intermediate transfer belt 10 is transferred onto the recording medium P.

The belt cleaner 21, disposed opposite the outer circumferential surface of the intermediate transfer belt 10, cleans the outer circumferential surface of the intermediate transfer belt 10.

Below the intermediate transfer unit 6 is a waste toner container 22 that collects waste toner conveyed from the belt cleaner 21 through a waste toner conveyance tube extending from the belt cleaner 21 to an inlet of the waste toner container 22.

Below the waste toner container 22 in a lower portion of the image forming apparatus 100 is a paper tray 13 that loads a plurality of recording media P (e.g., sheets and OHP (overhead projector) transparencies). The paper tray 13 is attached with a feed roller 14 that picks up and feeds a recording medium P toward the secondary transfer nip formed between the secondary transfer roller 12 and the intermediate transfer belt 10.

The recording medium P fed by the feed roller 14 is conveyed upward through a conveyance path R1 that extends from the paper tray 13 to a pair of output rollers 19*a* and 19*b*. The conveyance path R1 is provided with a pair of registration rollers 15*A* and 15*b* disposed below the secondary transfer nip formed between the secondary transfer roller 12 and the intermediate transfer belt 10, that is, upstream from the secondary transfer nip in a recording medium conveyance direction. The conveyance path R1 is further provided with a fixing device 16 disposed above the secondary transfer nip, that is, downstream from the secondary transfer nip in the recording medium conveyance direction. For example, the fixing device 16 includes a fixing roller 17 and a pressing roller 18 pressed against the fixing roller 17 to form a fixing nip N therebetween.

The pair of output rollers 19*a* and 19*b* is situated at a downstream terminal of the conveyance path R1 in the recording medium conveyance direction. An output tray 20, disposed atop the image forming apparatus 100, constitutes a top face of the image forming apparatus 100 that draws a downward curve in cross-section toward a position immediately underneath the pair of output rollers 19*a* and 19*b*. The output tray 20 receives the recording medium P discharged from the pair of output rollers 19*a* and 19*b*.

Referring to FIG. 5, the following describes the operation of the image forming apparatus 100 having the structure described above to form a color toner image on a recording medium P.

As the photoconductor 2Y rotates clockwise in FIG. 5 in a rotation direction B, the charging roller 3Y uniformly charges the outer circumferential surface of the photoconductor 2Y at a high potential. The exposure device 7 emits a laser beam L onto the charged outer circumferential surface of the photoconductor 2Y according to yellow image data sent from an external device (e.g., a client computer). The laser beam L decreases the potential of the outer circumferential surface of the photoconductor 2Y, forming an electrostatic latent image thereon. The development device 4Y supplies charged yellow toner that is electrostatically transferred to the electrostatic latent image formed on the photoconductor 2Y, visualizing the electrostatic latent image into a yellow toner image. Similarly, cyan, magenta, and black toner images are formed on the photoconductors 2C, 2M, and 2K, respectively.

A power supply applies a constant voltage or a constant current control voltage having a polarity opposite a polarity of yellow toner to the primary transfer roller 11Y.

Accordingly, a transfer electric field is created at the primary transfer nip formed between the primary transfer roller 11Y and the photoconductor 2Y. Consequently, as the photoconductor 2Y rotates in the rotation direction B and the intermediate transfer belt 10 rotates in the rotation direction A, the yellow toner image formed on the photoconductor 2Y is primarily transferred onto the intermediate transfer belt 10 at the primary transfer nip.

Similarly, the cyan, magenta, and black toner images formed on the photoconductors 2C, 2M, and 2K, respectively, are primarily transferred onto the intermediate transfer belt 10 in such a manner that the cyan, magenta, and black toner images are superimposed on the yellow toner image on the outer circumferential surface of the intermediate transfer belt 10, thus forming a color toner image thereon.

After the primary transfer of the yellow toner image from the photoconductor 2Y to the intermediate transfer belt 10, the cleaning blade 5Y removes residual yellow toner not transferred and therefore remaining on the photoconductor 2Y therefrom, thus cleaning the outer circumferential surface of the photoconductor 2Y. Further, a discharging lamp eliminates residual potential remaining on the photoconductor 2Y, discharging the outer circumferential surface of the photoconductor 2Y. Similarly, the outer circumferential surface of the respective photoconductors 2C, 2M, and 2K is cleaned and discharged.

On the other hand, the feed roller 14 rotates counterclockwise in FIG. 5 and feeds a recording medium P from the paper tray 13 toward the pair of registration rollers 15*A* and 15*b* through the conveyance path R1. As a leading edge of the recording medium P strikes the pair of registration rollers 15*A* and 15*b*, the pair of registration rollers 15*A* and 15*b* halts the recording medium P temporarily.

A power supply applies a voltage having a polarity opposite the polarity of toner to the secondary transfer roller 12, creating a transfer electric field at the secondary transfer nip formed between the secondary transfer roller 12 and the intermediate transfer belt 10. Alternatively, the power supply may apply a voltage having the same polarity as the polarity of toner to the driving roller 8 disposed opposite the secondary transfer roller 12, creating the transfer electric field at the secondary transfer nip. Then, the pair of registration rollers 15*a* and 15*b* resumes rotating to feed the recording medium P to the secondary transfer nip at a time when the color toner image formed on the intermediate transfer belt 10 is transferred onto the recording medium P. Accordingly, the color toner image formed on the intermediate transfer belt 10 is secondarily transferred onto the recording medium P by the transfer electric field generated at the secondary transfer nip. After the secondary transfer of the color toner image from the intermediate transfer belt 10 onto the recording medium P, the belt cleaner 21 removes residual toner not transferred onto the recording medium P and therefore remaining on the intermediate transfer belt 10 therefrom. The removed toner is collected into the waste toner container 22.

Thereafter, the recording medium P bearing the color toner image is conveyed to the fixing device 16. As the recording medium P is conveyed through the fixing nip N formed between the fixing roller 17 and the pressing roller 18, the fixing roller 17 and the pressing roller 18 apply heat and pressure to the recording medium P, melting and fixing the color toner image on the recording medium P. Then, the recording medium P bearing the fixed color toner image is discharged by the pair of output rollers 19*a* and 19*b* onto the output tray 20.

Figure 6:
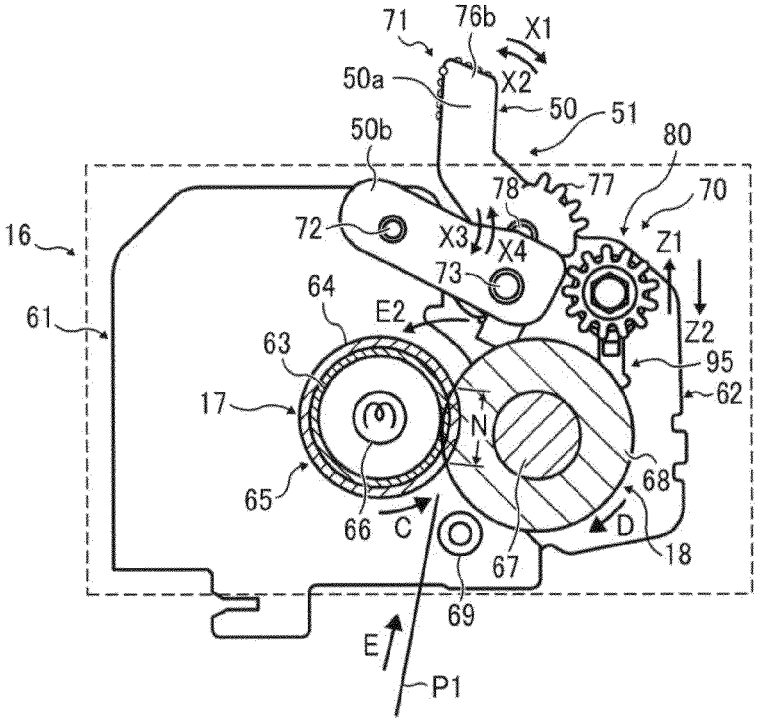
FIG. 6 is a vertical sectional view of a fixing device installed in the image forming apparatus shown in FIG. 5 in an enhanced pressure state in which a pressing roller presses against a fixing roller with enhanced pressure.
Figure 7:
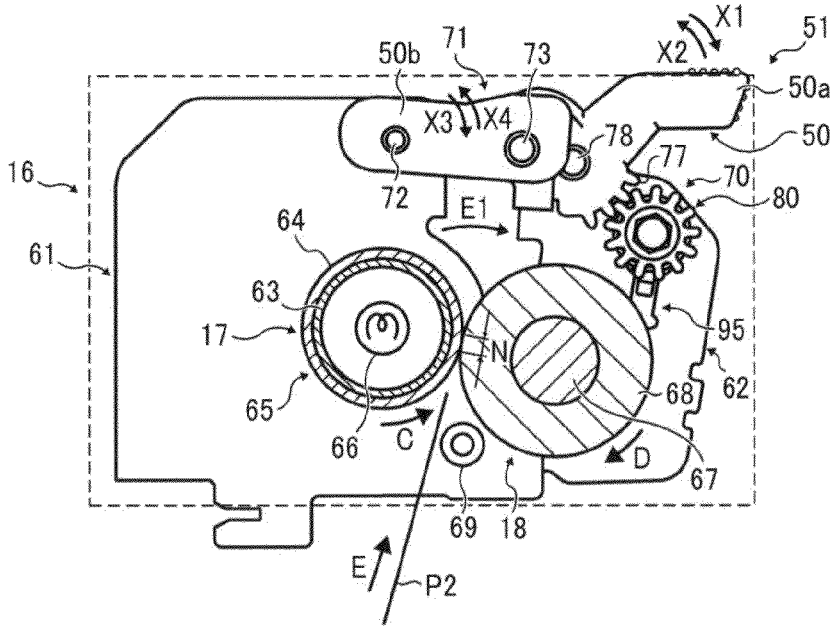
FIG. 7 is a vertical sectional view of the fixing device shown in FIG. 6 in a reduced pressure state in which the pressing roller presses against the fixing roller with reduced pressure.
Figure 8:
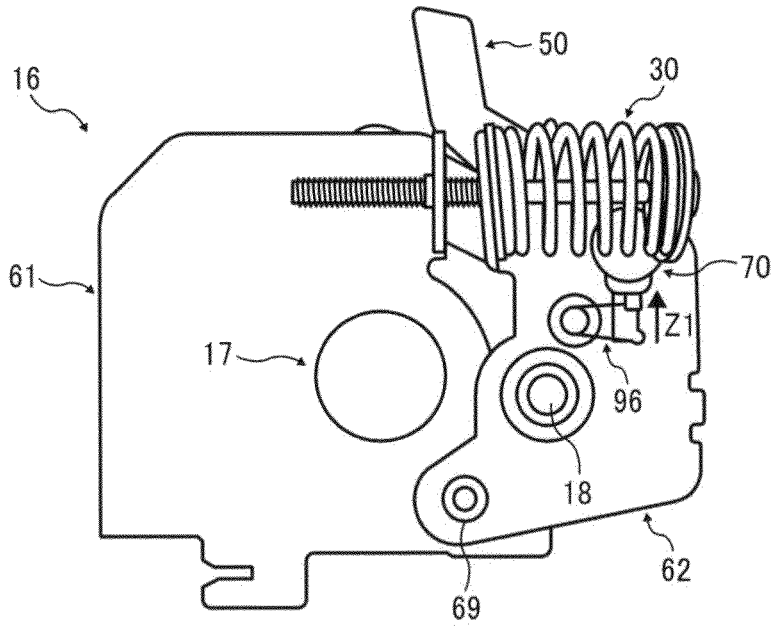
FIG. 8 is a vertical sectional view of the fixing device shown in FIG. 6 illustrating a resilient member incorporated therein.

Referring to FIGS. 6 to 8, the following describes the construction of the fixing device 16 installed in the image forming apparatus 100 described above.

FIG. 6 is a vertical sectional view of the fixing device 16 in an enhanced pressure state in which the pressing roller 18 presses against the fixing roller 17 with enhanced pressure. FIG. 7 is a vertical sectional view of the fixing device 16 in a reduced pressure state in which the pressing roller 18 presses against the fixing roller 17 with reduced pressure. FIG. 8 is a vertical sectional view of the fixing device 16 illustrating a spring 30 that presses the pressing roller 18 against the fixing roller 17. As shown in FIG. 6, the fixing device 16 (e.g., a fuser unit) includes the fixing roller 17 serving as a fixing rotary body or a first opposed body rotatable in a rotation direction C; the pressing roller 18 serving as a pressing rotary body or a second opposed body rotatable in a rotation direction D counter to the rotation direction C of the fixing roller 17; the spring 30 depicted in FIG. 8 that presses the pressing roller 18 against the fixing roller 17; a lever assembly 50 connected to the pressing roller 18; and a resistance applier 70 that separatably engages the lever assembly 50. The fixing roller 17 serving as a first opposed body, the pressing roller 18 serving as a second opposed body, the spring 30 serving as a resilient member, the lever assembly 50, and the resistance applier 70 constitute a lever switcher 51.

The lever assembly 50 switches between the enhanced pressure state and the reduced pressure state by moving the pressing roller 18 with respect to the fixing roller 17. The fixing roller 17 is supported by a fixing frame 61; the pressing roller 18 is supported by a pressing frame 62. That is, the fixing roller 17 is rotatably mounted on the fixing frame 61; the pressing roller 18 is rotatably mounted on the pressing frame 62. The pressing frame 62 mounting the pressing roller 18 is rotatable about a shaft 69 mounted on the fixing frame 61. A resilient member, in this case the spring 30, attached to the fixing frame 61 and the pressing frame 62 exerts a resilient bias to the pressing frame 62, thus pressing the pressing roller 18 supported by the pressing frame 62 against the fixing roller 17 supported by the fixing frame 61 to form the fixing nip N between the pressing roller 18 and the fixing roller 17. The spring 30 has a spring load of about 65N; the fixing nip N has a nip load of about 340 N.

A detailed description is now given of the construction of the fixing roller 17.

The fixing roller 17 is constructed of a hollow tube 65 including a thermal conductive base layer 63 and an outer layer 64 coating the base layer 63. In addition, a heater 66 (e.g., a halogen heater, an infrared heater, and an induction heater) is disposed inside the hollow tube 65. Alternatively, the heater 66 may be disposed outside the fixing roller 17 or an additional heater may be disposed inside or outside the pressing roller 18. The outer layer 64 of the hollow tube 65 is constructed of an elastic layer and a surface layer coating the elastic layer.

The thermal conductive base layer 63, having a predetermined mechanical strength, is made of thermal conductive carbon steel or aluminum. The elastic layer of the outer layer 64 is made of synthetic rubber such as silicone rubber or fluoro rubber. The surface layer of the outer layer 64 is made of materials with high thermal conductivity and durability that facilitate separation of toner of a toner image on plain paper P1 or an envelope P2 from the fixing roller 17 and enhance the durability of the elastic layer. For example, the surface layer of the outer layer 64 may be a tetrafluoroethylene-perfluoroalkylvinylether copolymer (PFA) tube, a layer coated with fluoroplastic such as PFA, or a layer cladded with silicone rubber or fluoro rubber.

The fixing roller 17 has an outer loop diameter in a range of from about 15 mm to about 40 mm. The elastic layer of the outer layer 64 has a thickness in a range of from about 0.5 mm to about 3.0 mm. The surface layer of the outer layer 64 has a thickness in a range of from about 10 micrometers to about 80 micrometers. According to this exemplary embodiment, the fixing roller 17 has an outer loop diameter of about 24 mm. The elastic layer of the outer layer 64 has a thickness of about 1 mm and the surface layer of the outer layer 64 has a thickness of about 43 micrometers.

A detailed description is now given of the construction of the pressing roller 18.

The pressing roller 18 is constructed of a metal core 67 and an outer layer 68 coating the metal core 67. The outer layer 68 includes an elastic layer and a surface layer coating the elastic layer. For example, the metal core 67 is made of carbon steel tubes for machine structural purposes (STKM). The elastic layer of the outer layer 68 is made of silicone rubber, fluoro rubber, silicone rubber foam, fluoro rubber foam, or the like. The surface layer of the outer layer 68 is made of a heat-resistant fluoroplastic tube, such as PFA or polytetrafluoroethylene (PTFE), that facilitates separation of the toner image on the plain paper P1 or the envelope P2 from the pressing roller 18.

The pressing roller 18 has an outer loop diameter in a range of from about 20 mm to about 40 mm. The elastic layer of the outer layer 68 has a thickness in a range of from about 0.5 mm to about 10.0 mm. The surface layer of the outer layer 68 has a thickness in a range of from about 10 micrometers to about 80 micrometers. According to this exemplary embodiment, the pressing roller 18 has an outer loop diameter of about 30 mm. The elastic layer of the outer layer 68 has a thickness of about 8 mm and the surface layer of the outer layer 68 has a thickness of about 50 micrometers.

A detailed description is now given of the components disposed in proximity to the fixing roller 17.

A thermistor serving as a temperature detector that detects the temperature of the fixing roller 17 and a thermistor that prevents overheating of the fixing roller 17 are disposed opposite an outer circumferential surface of the fixing roller 17. A detection signal is output from these thermistors and sent to a controller 99 depicted in FIG. 5. The controller 99, that is, a microprocessor, for example, controls the heater 66 based on the detection signal sent from the thermistors, maintaining the temperature of the fixing roller 17 at a predetermined temperature range.

An entry guide, disposed upstream from the fixing nip N in a recording medium conveyance direction E, guides the plain paper P1 or the envelope P2 to the fixing nip N. An exit guide, disposed downstream from the fixing nip N in the recording medium conveyance direction E, guides the plain paper P1 or the envelope P2 discharged from the fixing nip N toward the pair of output rollers 19*a* and 19*b* depicted in FIG. 5.

Referring to FIGS. 5 to 9, the following describes the construction of the lever assembly 50 disposed downstream from the fixing nip N in the recording medium conveyance direction E.

Figure 9:
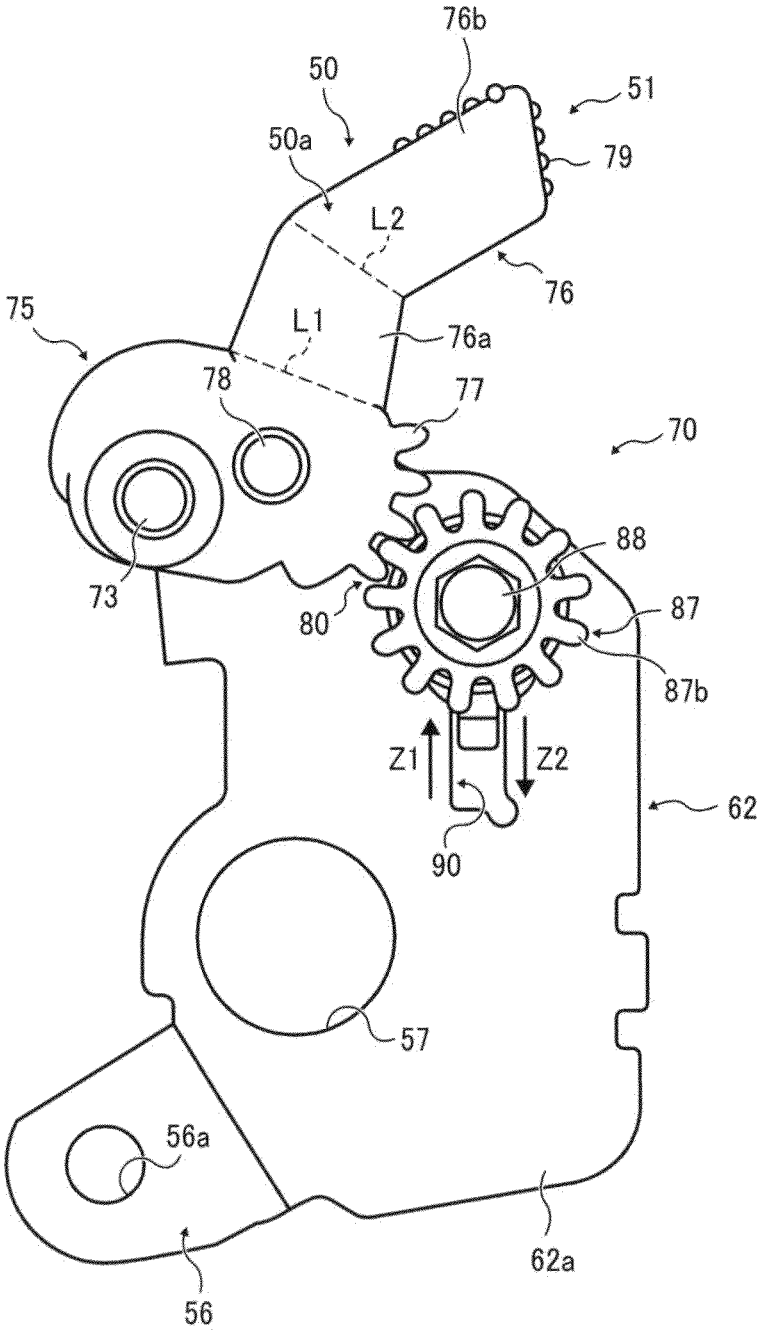
FIG. 9 is a vertical sectional view of a lever assembly and a pressing frame incorporated in the fixing device shown in FIG. 6.

FIG. 9 is a vertical sectional view of the lever assembly 50 and the pressing frame 62. As shown in FIG. 6, the lever assembly 50 includes a link assembly 71 constructed of a first linkage 50*a* and a second linkage 50*b*. One end, that is, a left end in FIG. 6, of the second linkage 50*b* (e.g., a lever arm) in a longitudinal direction thereof is pivotally mounted on the fixing frame 61 by a pin 72 (e.g., a pivot pin). Another end, that is, a right end in FIG. 6, of the second linkage 50*b* in the longitudinal direction thereof is pivotally mounted on the first linkage 50*a* by a pin 73 (e.g., a pivot pin).

As shown in FIG. 9, the first linkage 50*a* (e.g., a lever arm) includes an elliptical body 75 and a control portion 76 protruding from the elliptical body 75. The elliptical body 75, pivotally mounted on the pressing frame 62 by a pin 78 (e.g., a pivot pin), includes teeth 77 mounted on one arcuate portion of the elliptical body 75. The elliptical body 75 is pivotally mounted on the right end in FIG. 6 of the second linkage 50*b* by the pin 73. The control portion 76 is constructed of a base 76*a* protruding from a dotted line L1, that is, an upper border of the elliptical body 75, in a direction substantially orthogonal to a longitudinal direction of the elliptical body 75; and a tilt portion 76*b* obliquely protruding from a dotted line L2, that is, an upper border of the base 76*a*. The tilt portion 76*b* is attached with an anti slip member 79 touched by a finger of a user who swings the first linkage 50*a*.

Figure 10:
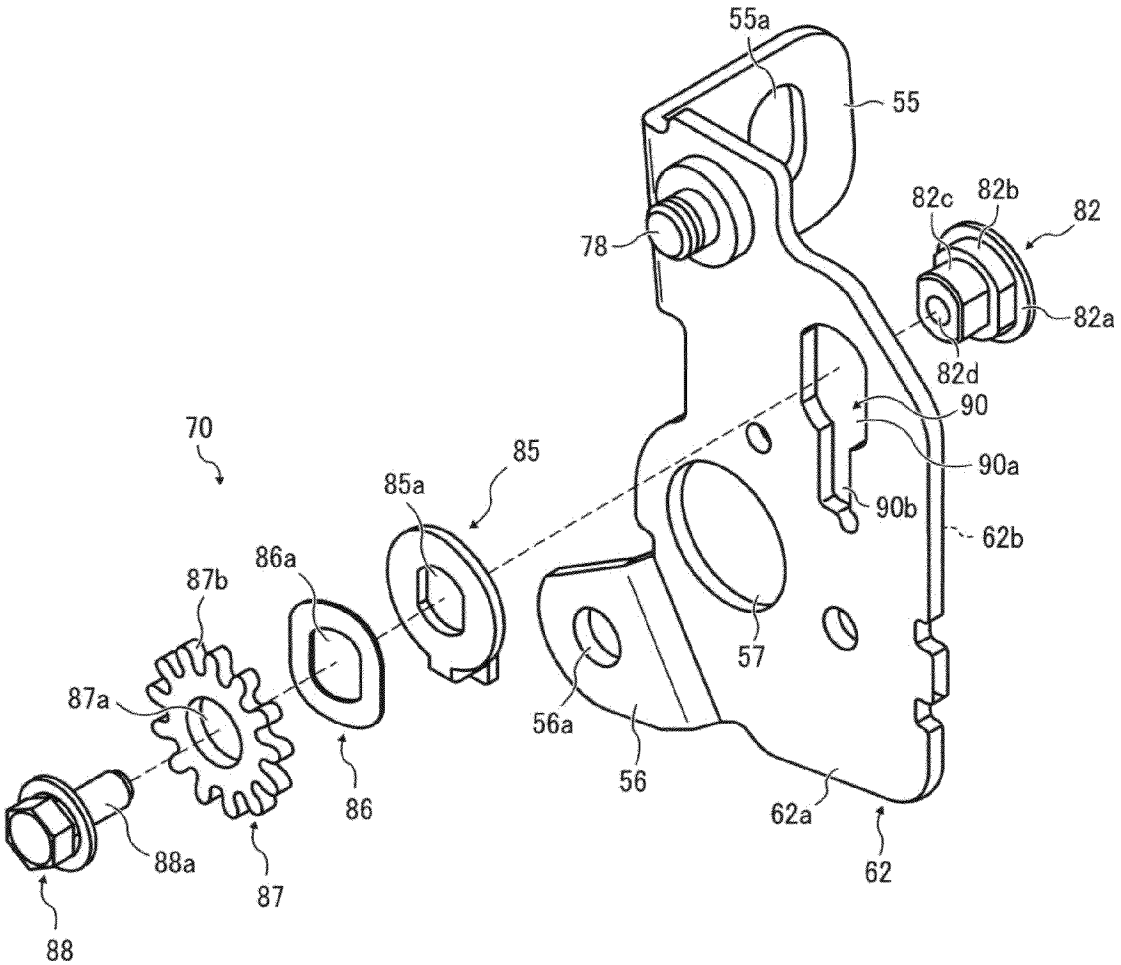
FIG. 10 is an exploded view of a resistance applier and a pressing frame incorporated in the fixing device shown in FIG. 6.

Referring to FIG. 10, a detailed description is now given of the construction of the resistance applier 70 and the pressing frame 62.

FIG. 10 is an exploded view of the resistance applier 70 and the pressing frame 62. The resistance applier 70 is a torque limiter. The resistance applier 70 includes a receiver 82, a plate 85 provided with a through-hole 85*a*, a wave washer 86 provided with a through-hole 86*a*, a gear 87 provided with a through-hole 87*a* and teeth 87*b* mounted on a circumferential edge of the gear 87, and a bolt 88 provided with a male thread 88*a*.

For example, the receiver 82 includes a brim 82*a*, a boss 82*b*, a shaft 82*c*, and a female thread 82*d*. The shaft 82*c* and the female thread 82*d* constitute a female-threaded nut. The brim 82*a* is a disc. The boss 82*b* is an elliptical flat plate. The shaft 82*c* is an elliptical minor axis. The shaft 82*c* of the receiver 82 engages a through-hole 90 produced through the pressing frame 62. The through-hole 90 is constructed of an elliptical hole 90*a* and a slit 90*b* for clearance contiguous to a lower border of the elliptical hole 90*a*. The pressing frame 62 includes two mounting plates 55 and 56. The mounting plate 55 is provided with a through-hole 55*A* through which a shaft is inserted to support the pressing frame 62. The mounting plate 56 is provided with a through-hole 56*a* through which the shaft 69 depicted in FIG. 6 is inserted. Further, the pressing frame 62 is provided with a through-hole 57 that supports the pressing roller 18 depicted in FIG. 6.

The shaft 82*c* of the receiver 82 disposed opposite a back face 62*b* of the pressing frame 62 is inserted into the through-hole 90. The plate 85, the wave washer 86, and the gear 87 disposed opposite a front face 62*a* of the pressing frame 62 engage the shaft 82*c* of the receiver 82 that protrudes from the front face 62*a* of the pressing frame 62. The male thread 88*a* of the bolt 88 is inserted through the through-hole 87*a* of the gear 87, the through-hole 86*a* of the wave washer 86, and the through-hole 85*A* of the plate 85 and engages the female thread 82*d* of the receiver 82.

As the bolt 88 is screwed through the receiver 82, since the plate 85 and the gear 87 sandwich the wave washer 86, resistance (e.g., torque) is exerted to the rotating gear 87 by friction. A biasing member 96 (e.g., a torsion spring) depicted in FIG. 8 exerts a resilient bias to the resistance applier 70 in a direction Z1 depicted in FIG. 9 to locate the resistance applier 70 at the elliptical hole 90*a* depicted in FIG. 10 of the through-hole 90 of the pressing frame 62. Thus, as shown in FIG. 9, the resistance applier 70 engages the lever assembly 50 through a gear engagement 80 between the teeth 87*b* of the gear 87 of the resistance applier 70 and the teeth 77 of the first linkage 50*a* of the lever assembly 50.

As shown in FIG. 6, the pressing roller 18 is pressed against the fixing roller 17 with enhanced pressure therebetween by a resilient bias exerted by the spring 30 depicted in FIG. 8, producing the longer fixing nip N in the recording medium conveyance direction E. Accordingly, the pressing frame 62 is disposed closer to the fixing frame 61, directing the tilt portion 76*b* of the first linkage 50*a* of the lever assembly 50 in a vertical direction. In the enhanced pressure state in which the pressing roller 18 presses against the fixing roller 17 with enhanced pressure as shown in FIG. 6, the fixing nip N has a length of about 6.5 mm in the recording medium conveyance direction E.

As the first linkage 50*a* of the lever assembly 50 swings about the pin 78 in a direction X1, since the first linkage 50*a* is coupled to the second linkage 50*b* through the pin 73, the second linkage 50*b* swings about the pin 72 in a direction X4. Accordingly, the pressing frame 62 swings about the shaft 69 in a direction E1 depicted in FIG. 7. Consequently, the pressing roller 18 presses against the fixing roller 17 with reduced pressure therebetween, producing the shorter fixing nip N in the recording medium conveyance direction E as shown in FIG. 7. In the reduced pressure state in which the pressing roller 18 presses against the fixing roller 17 with reduced pressure as shown in FIG. 7, the fixing nip N has a length of about 2.0 mm in the recording medium conveyance direction E.

Conversely, as the first linkage 50*a* of the lever assembly 50 swings about the pin 78 in a direction X2, the second linkage 50*b* of the lever assembly 50 swings about the pin 72 in a direction X3. Accordingly, the pressing frame 62 swings about the shaft 69 in a direction E2 depicted in FIG. 6. Consequently, the pressing roller 18 presses against the fixing roller 17 with enhanced pressure therebetween, producing the longer fixing nip N in the recording medium conveyance direction E as shown in FIG. 6.

As shown in FIG. 7, as the first linkage 50*a* of the lever assembly 50 swings in the direction X2, the teeth 87*b* of the gear 87 of the resistance applier 70 depicted in FIG. 9 still engage the teeth 77 of the first linkage 50*a* of the lever assembly 50. Accordingly, the resistance applier 70 exerts drag on the first linkage 50*a* of the lever assembly 50. Consequently, during transition from the reduced pressure state shown in FIG. 7 to the enhanced pressure state shown in FIG. 6, drag exerted by the resistance applier 70 decreases the resilient bias exerted by the spring 30 depicted in FIG. 8 to press the pressing roller 18 against the fixing roller 17.

If the teeth 77 of the lever assembly 50 are configured to engage the teeth 87*b* of the gear 87 of the resistance applier 70 as the lever assembly 50 swings in the direction X1, the resistance applier 70 might generate drag against the swing of the lever assembly 50 in the direction X1. However, as the lever assembly 50 swings in the direction X1, the spring 30 presses the pressing roller 18 against the fixing roller 17. That is, the spring 30 generates drag against the swing of the lever assembly 50, thus rendering drag of the resistance applier 70 unnecessary.

Figure 11:
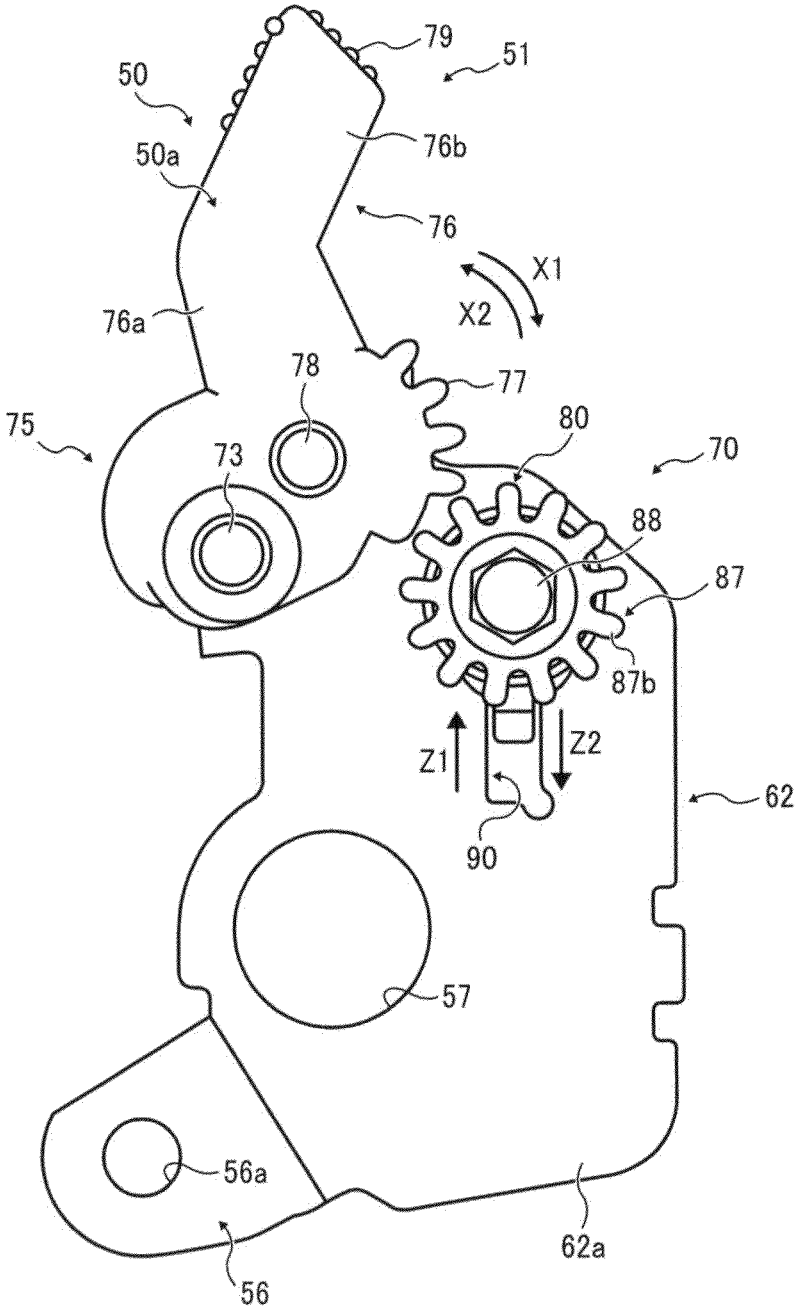
FIG. 11 is a vertical sectional view of a first linkage of the lever assembly and the pressing frame shown in FIG. 9.
Figure 12:
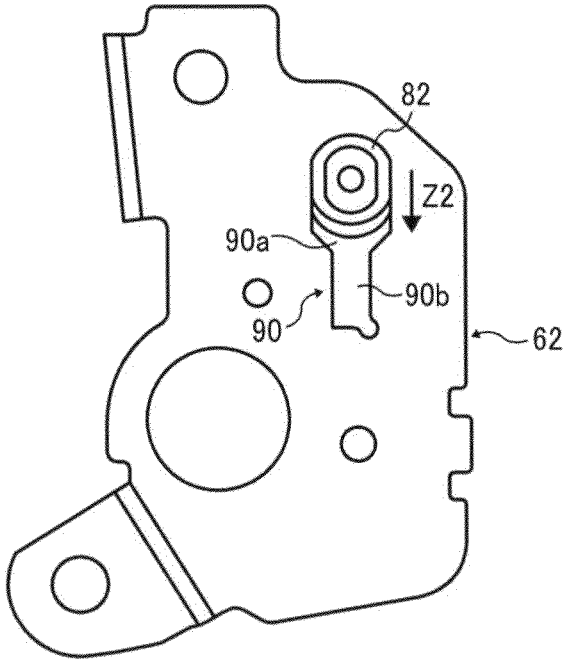
FIG. 12 is a vertical front view of the pressing frame shown in FIG. 9 illustrating a through-hole therethrough and a receiver of the resistance applier shown in FIG. 10 that moves in the through-hole.

To address this circumstance, as shown in FIG. 11 illustrating a vertical sectional view of the first linkage 50*a* of the lever assembly 50 and the pressing frame 62, as the lever assembly 50 swings in the direction X1, the resistance applier 70 lowers in a direction Z2 against a resilient bias exerted by the biasing member 96 depicted in FIG. 8 in the direction Z1 counter to the direction Z2, thereby separating the teeth 87*b* of the gear 87 from the teeth 77 of the lever assembly 50. Specifically, as shown in FIG. 12 illustrating the through-hole 90 produced through the pressing frame 62 and the receiver 82 of the resistance applier 70, the receiver 82 moves in the direction Z2 in the elliptical hole 90*a* of the through-hole 90. Accordingly, even if the first linkage 50*a* of the lever assembly 50 swings in the direction X1, the first linkage 50*a* can escape from drag generated by the resistance applier 70. As shown in FIG. 7, the reduced pressure state is maintained by the link assembly 71 of the lever assembly 50.

Figure 3:
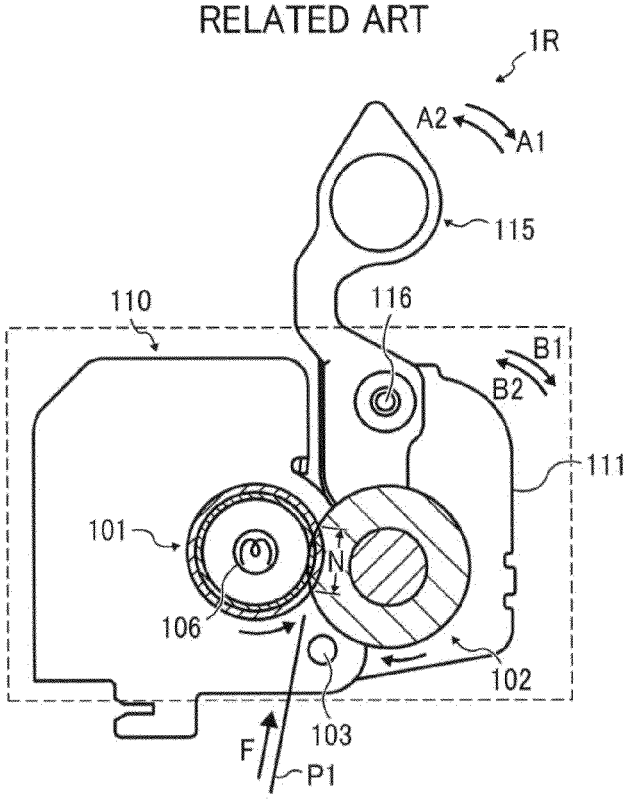
FIG. 3 RELATED ART
FIG. 3 is a schematic vertical sectional view of the related-art fixing device shown in FIG. 1 illustrating a lever that produces the enhanced pressure state.
Figure 4:
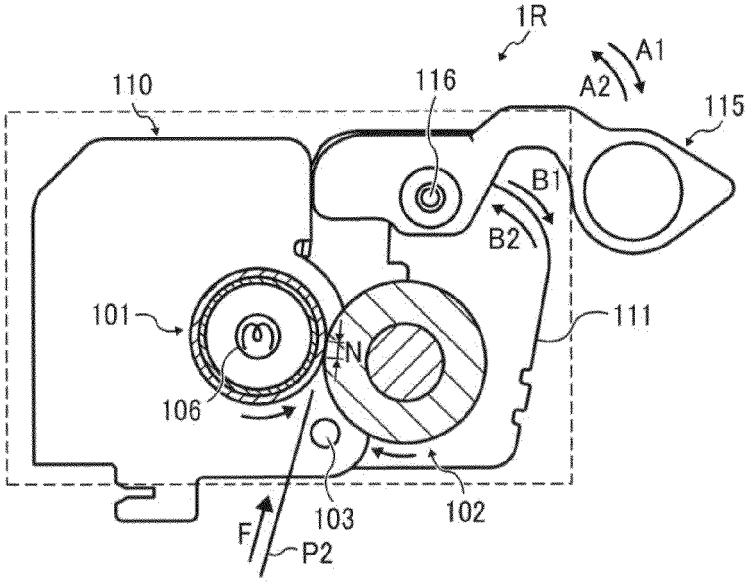
FIG. 4 RELATED ART
FIG. 4 is a schematic vertical sectional view of the related-art fixing device shown in FIG. 2 illustrating the lever that produces the reduced pressure state.

According to this exemplary embodiment, the fixing device 16 includes the lever switcher 51 constructed of a dual linkage mechanism, that is, the first linkage 50*a* and the second linkage 50*b*, downsizing the fixing device 16 and decreasing the force required to press the pressing roller 18 against the fixing roller 17 to about 20 N or smaller. By contrast, if the fixing device 16 includes a lever switcher constructed of a single linkage mechanism (e.g., the lever 115 shown in FIG. 3), the pressing roller 18 may be isolated from the fixing roller 17 with a decreased interval therebetween, requiring a greater force to move the lever switcher to create a greater interval between the pressing roller 18 and the fixing roller 17.

Further, according to this exemplary embodiment, transition from the reduced pressure state shown in FIG. 7 to the enhanced pressure state shown in FIG. 6 is possible with a decreased resilient bias exerted by the spring 30 depicted in FIG. 8, minimizing mechanical shock and sound caused by the first linkage 50*a* and the second linkage 50*b* returning from the reduced pressure position shown in FIG. 7 to the enhanced pressure position shown in FIG. 6. Accordingly, the reduced pressure state and the enhanced pressure state are maintained stably with improved reliability of transition between the reduced pressure state and the enhanced pressure state. Moreover, neither a cushion that absorbs mechanical shock nor a solenoid that moves the cushion to prevent the cushion from obstructing movement of the lever assembly 50 is needed to minimize mechanical shock and sound, resulting in reduced manufacturing costs.

As shown in FIG. 9, according to this exemplary embodiment, the resistance applier 70 engages the lever assembly 50 with the gear engagement 80 between the teeth 87*b* of the resistance applier 70 and the teeth 77 of the lever assembly 50, thus stably minimizing mechanical shock and sound that may generate when the lever assembly 50 returns to the enhanced pressure position shown in FIG. 6 from the reduced pressure position shown in FIG. 7. Further, as shown in FIG. 9, the teeth 77 are mounted on a part of a circumferential edge of the elliptical body 75 of the first linkage 50*a* of the lever assembly 50. Accordingly, the resistance applier 70 exerts resistance, that is, drag, on the lever assembly 50 only when needed. For example, when transition from the reduced pressure state shown in FIG. 7 to the enhanced pressure state shown in FIG. 6 is almost completed, the teeth 77 of the lever assembly 50 may be configured to separate from the teeth 87*b* of the resistance applier 70.

Referring to FIGS. 6 to 8, a detailed description is now given of the construction of a separator 95.

As the lever assembly 50 swings from the enhanced pressure position shown in FIG. 6 to the reduced pressure position shown in FIG. 7, that is, as the first linkage 50*a* swings in the direction X1 and the second linkage 50*b* swings in the direction X4, the separator 95 separates the resistance applier 70 from the lever assembly 50 to prohibit the resistance applier 70 from exerting resistance, that is, drag, on the lever assembly 50. Accordingly, transition from the enhanced pressure state shown in FIG. 6 to the reduced pressure state shown in FIG. 7 is performed stably. For example, the lever assembly 50 moves from the enhanced pressure position shown in FIG. 6 to the reduced pressure position shown in FIG. 7 against a resilient bias exerted by the spring 30 depicted in FIG. 8. Hence, if the fixing device 16 is not provided with the separator 95, it is necessary to swing the lever assembly 50 in a direction against both a resilient bias exerted by the spring 30 and drag exerted by the resistance applier 70.

As shown in FIG. 8, the separator 95 includes the biasing member 96 (e.g., a torsion spring) that exerts a bias to the resistance applier 70 in the direction Z1 that causes the resistance applier 70 to resist the lever assembly 50. For example, the biasing member 96 constantly exerts a bias to the resistance applier 70 so that the resistance applier 70 exerts resistance to the lever assembly 50. Hence, during transition from the reduced pressure state shown in FIG. 7 to the enhanced pressure state shown in FIG. 6, the resistance applier 70 exerts resistance to the lever assembly 50 stably, minimizing mechanical shock that may generate as the lever assembly 50 moves from the reduced pressure position shown in FIG. 7 to the enhanced pressure position shown in FIG. 6.

The separator 95 attains stable transition from the enhanced pressure state shown in FIG. 6 to the reduced pressure state shown in FIG. 7, that is, movement of the lever assembly 50 from the enhanced pressure position shown in FIG. 6 to the reduced pressure position shown in FIG. 7, thus facilitating operation of the lever assembly 50.

The image forming apparatus 100 depicted in FIG. 5 incorporates the fixing device 16 that attains the advantages described above. Accordingly, the fixing device 16 provides improved fixing on envelopes as well as plain paper without creasing the envelopes and at the same time minimizes sound at reduced manufacturing costs. Hence, the image forming apparatus 100 incorporating the fixing device 16 forms a high quality toner image on a recording medium at reduced manufacturing costs.

For example, the enhanced pressure state shown in FIG. 6 that provides the longer fixing nip N defines a plain paper mode in which plain paper P1 is used as a recording medium. Conversely, the reduced pressure state shown in FIG. 7 that provides the shorter fixing nip N defines an envelope mode in which an envelope P2 is used as a recording medium. Specifically, when an envelope P2 is conveyed through the fixing nip N, the pressing roller 18 presses against the fixing roller 17 with reduced pressure to form the shorter fixing nip N, thus preventing creasing of the envelope P2. Conversely, when plain paper P1 is conveyed through the fixing nip N, the pressing roller 18 presses against the fixing roller 17 with enhanced pressure to form the longer fixing nip N, thus applying sufficient heat and pressure to the plain paper P1. Alternatively, the reduced pressure state shown in FIG. 7 may also define a power off mode in which the image forming apparatus 100 is powered off because it is not being used or is being shipped, thus preventing plastic deformation of the fixing roller 17 and the pressing roller 18 and reducing image noise and operation noise.

According to this exemplary embodiment, the fixing device 16 provides two modes, that is, the plain paper mode shown in FIG. 6 and the envelope mode shown in FIG. 7. Alternatively, the fixing device 16 may further provide a third mode. For example, the third mode may be a minimized pressure mode in which the pressing roller 18 presses against the fixing roller 17 with minimized pressure to form the fixing nip N even shorter than the shorter fixing nip N in the envelope mode shown in FIG. 7 or a non-nip mode in which the fixing nip N is not formed. The minimized pressure mode and the non-nip mode press the pressing roller 18 against the fixing roller 17 with minimized pressure or no pressure at all. Hence, these modes may define the power off mode in which the image forming apparatus 100 is powered off because it is not being used or is being shipped, thus preventing plastic deformation of the fixing roller 17 and the pressing roller 18 more effectively.

Alternatively, the third mode may be an intermediate pressure mode in which the pressing roller 18 presses against the fixing roller 17 with intermediate pressure between enhanced pressure in the plain paper mode shown in FIG. 6 and reduced pressure in the envelope mode shown in FIG. 7. The intermediate pressure mode forms the intermediate fixing nip N between the longer fixing nip N shown in FIG. 6 and the shorter fixing nip N shown in FIG. 7, which applies appropriate heat and pressure to a recording medium suitable for the intermediate fixing nip N, for example, a recording medium having a thickness smaller than that of plain paper.

In order to provide the three modes described above, that is, the plain paper mode, the envelope mode, and the third mode, it is necessary to position the pressing roller 18 with respect to the fixing roller 17 at three different positions. To address this, the lever assembly 50 may have a linkage mechanism corresponding to the respective modes.

As shown in FIG. 10, the resistance applier 70 is a torque limiter incorporating the wave washer 86. Alternatively, the resistance applier 70 may be a torque limiter incorporating oil or a plate spring. That is, the resistance applier 70 may be a torque limiter of various types. For example, various commercial torque limiters may be employed as the resistance applier 70 at reduced manufacturing costs.

The present invention is not limited to the details of the exemplary embodiments described above, and various modifications and improvements are possible.

For example, the image forming apparatus 100 may be a copier, a printer, a facsimile machine, a multifunction printer having at least one of copying, printing, facsimile, and scanning functions, or the like. The exemplary embodiments described above are applied to the fixing device 16 where the first opposed body or the fixing rotary body (e.g., the fixing roller 17), the second opposed body or the pressing rotary body (e.g., the pressing roller 18), and the spring 30 form the fixing nip N. Alternatively, the exemplary embodiments described above may be applied to other configurations that form a nip, for example, a nip formed between the charging roller 3Y and the photoconductor 2Y as shown in FIG. 5. Further, the exemplary embodiments described above are applied to the fixing device 16 that provides two or three levels of pressure exerted at the fixing nip N. Alternatively, the exemplary embodiments described above may be applied to other configurations that provide four or more levels of pressure exerted at a nip formed between two components pressed against each other.

Referring to FIGS. 5 to 8, the following describes advantages of the lever switcher 51 and the fixing device 16 incorporating the lever switcher 51.

As shown in FIGS. 6 to 8, the lever switcher 51 includes the fixing roller 17 serving as a first opposed body or a fixing rotary body; the pressing roller 18 serving as a second opposed body or a pressing rotary body; and the spring 30 that exerts a resilient bias to the pressing roller 18 to press the pressing roller 18 against the fixing roller 17. The lever assembly 50 moves the pressing roller 18 with respect to the fixing roller 17 between the reduced pressure position, that is, the reduced pressure state, where the pressing roller 18 presses against the fixing roller 17 with reduced pressure therebetween and the enhanced pressure position, that is, the enhanced pressure state, where the pressing roller 18 presses against the fixing roller 17 with enhanced pressure therebetween. As the lever assembly 50 swings to switch from the reduced pressure state shown in FIG. 7 to the enhanced pressure state shown in FIG. 6, that is, as the lever assembly 50 swings to move the pressing roller 18 from the reduced pressure position where the pressing roller 18 presses against the fixing roller 17 with reduced pressure therebetween to the enhanced pressure position where the pressing roller 18 presses against the fixing roller 17 with enhanced pressure therebetween, the resistance applier 70 exerts drag on the lever assembly 50.

As the lever assembly 50 swings in the direction X1, the lever assembly 50 moves the pressing roller 18 to the reduced pressure position where the pressing roller 18 presses against the fixing roller 17 with reduced pressure therebetween. Conversely, as the lever assembly 50 swings in the direction X2 counter to the direction X1, the lever assembly 50 moves the pressing roller 18 to the enhanced pressure position where the pressing roller 18 presses against the fixing roller 17 with enhanced pressure therebetween. As the lever assembly 50 swings in the direction X2, the resistance applier 70 exerts drag on the lever assembly 50. Accordingly, drag exerted by the resistance applier 70 decreases a resilient bias exerted by the spring 30 to the pressing roller 18, gentling swinging of the lever assembly 50.

The fixing device 16 includes the fixing roller 17 serving as the fixing rotary body inside which the heater 66 is disposed and the pressing roller 18 serving as the pressing rotary body that presses against the fixing roller 17 to form the fixing nip N therebetween. As a recording medium bearing an unfixed toner image is conveyed through the fixing nip N, the fixing roller 17 heated by the heater 66 and the pressing roller 18 apply heat and pressure to the recording medium, fixing the toner image on the recording medium. When the lever switcher 51 is installed in the fixing device 16, the fixing roller 17 serves as the first opposed body and the pressing roller 18 serves as the second opposed body, thus attaining the advantages described above.

As shown in FIGS. 6 and 7, the lever switcher 51 incorporates the lever assembly 50 that moves the pressing roller 18 with respect to the fixing roller 17, readily switching between the reduced pressure state in which the pressing roller 18 presses against the fixing roller 17 with reduced pressure therebetween and the enhanced pressure state in which the pressing roller 18 presses against the fixing roller 17 with enhanced pressure therebetween.

Additionally, the lever switcher 51 further incorporates the resistance applier 70 that decreases the resilient bias exerted by the spring 30 to the pressing roller 18 as the lever assembly 50 moves the pressing roller 18 from the reduced pressure position where the pressing roller 18 presses against the fixing roller 17 with reduced pressure therebetween in the reduced pressure state to the enhanced pressure position where the pressing roller 18 presses against the fixing roller 17 with enhanced pressure therebetween in the enhanced pressure state. Hence, the resistance applier 70 decreases mechanical shock caused by the lever assembly 50 during switching between the reduced pressure state and the enhanced pressure state. Further, the lever switcher 51 maintains the reduced pressure state and the enhanced pressure state stably and improves reliability of switching between the reduced pressure state and the enhanced pressure state with minimized sound generated by the lever assembly 50. Accordingly, the lever switcher 51 requires neither a cushion that cushions mechanical shock caused by the lever assembly 50 nor a relatively expensive solenoid that moves the cushion, resulting in reduced manufacturing costs of the fixing device 16.

The fixing device 16 incorporating the lever switcher 51 attains the advantages of the lever switcher 51 described above.

For example, as shown in FIG. 6, when plain paper P1 is used as a recording medium, the lever assembly 50 presses the pressing roller 18 against the fixing roller 17 with enhanced pressure therebetween to form the longer fixing nip N in the recording medium conveyance direction E, thus applying sufficient heat and pressure to the plain paper P1. Conversely, as shown in FIG. 7, when an envelope P2 is used as a recording medium, the lever assembly 50 presses the pressing roller 18 against the fixing roller 17 with reduced pressure therebetween to form the shorter fixing nip N in the recording medium conveyance direction E, thus preventing creasing of the envelope P2.

As shown in FIG. 5, the image forming apparatus 100 incorporates the fixing device 16 attaining the advantages described above, thus forming a high quality toner image on a recording medium at reduced manufacturing costs.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A lever switcher comprising:
a first opposed body;
a second opposed body pressed against the first opposed body;
a resilient member connected to the second opposed body to exert a resilient bias to the second opposed body that presses the second opposed body against the first opposed body;
a lever assembly connected to the second opposed body and swingable to move the second opposed body against the resilient bias exerted by the resilient member between at least a reduced pressure position where the second opposed body presses against the first opposed body with reduced pressure therebetween and an enhanced pressure position where the second opposed body presses against the first opposed body with enhanced pressure therebetween, the lever assembly including a first linkage and a second linkage; and
a resistance applier to engage the lever assembly to exert drag on the lever assembly when the lever assembly moves the second opposed body from the reduced pressure position to the enhanced pressure position.

2. The lever switcher according to claim 1, wherein the resistance applier includes a torque limiter using oil.

3. The lever switcher according to claim 1, wherein the resistance applier includes a torque limiter using a plate spring.

4. The lever switcher according to claim 1, wherein the resistance applier includes a torque limiter using a wave washer.

5. The lever switcher according to claim 1, further comprising a separator contacting the resistance applier, through which the resistance applier moves to separate from the lever assembly when the lever assembly moves the second opposed body from the enhanced pressure position to the reduced pressure position.

6. The lever assembly according to claim 5, wherein the separator includes a biasing member contacting the resistance applier to exert a bias that presses the resistance applier against the lever assembly so that the resistance applier exerts drag on the lever assembly.

7. The lever assembly according to claim 1, wherein the lever assembly is swingable to move the second opposed body to a third position different from the reduced pressure position and the enhanced pressure position.

8. A lever switcher comprising:
a first opposed body;
a second opposed body pressed against the first opposed body;
a resilient member connected to the second opposed body to exert a resilient bias to the second opposed body that presses the second opposed body against the first opposed body;
a lever assembly connected to the second opposed body and swingable to move the second opposed body against the resilient bias exerted by the resilient member between at least a reduced pressure position where the second opposed body presses against the first opposed body with reduced pressure therebetween and an enhanced pressure position where the second opposed body presses against the first opposed body with enhanced pressure therebetween; and
a resistance applier to engage the lever assembly to exert drag on the lever assembly when the lever assembly moves the second opposed body from the reduced pressure position to the enhanced pressure position, wherein the lever assembly includes teeth and the resistance applier includes teeth that engage the teeth of the lever assembly.

9. A fixing device comprising:

a fixing rotary body;

a heater disposed opposite the fixing rotary body to heat the fixing rotary body;

a pressing rotary body pressed against the fixing rotary body to form a fixing nip therebetween through which a recording medium bearing a toner image is conveyed;

a resilient member connected to the pressing rotary body to exert a resilient bias to the pressing rotary body that presses the pressing rotary body against the fixing rotary body;

a lever assembly connected to the pressing rotary body and swingable to move the pressing rotary body against the resilient bias exerted by the resilient member between at least a reduced pressure position where the pressing rotary body presses against the fixing rotary body with reduced pressure therebetween and an enhanced pressure position where the pressing rotary body presses against the fixing rotary body with enhanced pressure therebetween, the lever assembly including a first linkage and a second linkage; and a resistance applier to engage the lever assembly to exert drag on the lever assembly when the lever assembly moves the pressing rotary body from the reduced pressure position to the enhanced pressure position.

10. The fixing device according to claim 9, further comprising:

a fixing frame rotatably mounting the fixing rotary body and stationarily mounting a shaft; and a pressing frame rotatably mounting the pressing rotary body and attached to the fixing frame, wherein the pressing frame is rotatable about the shaft mounted on the fixing frame, the lever assembly is swingably attached to the fixing frame and the pressing frame, and the resistance applier is movably attached to the pressing frame.

11. The fixing device according to claim 10, wherein the lever assembly includes:

a first linkage pivotably attached to the pressing frame; and a second linkage pivotably attached to the fixing frame, wherein the first linkage and the second linkage are swingably coupled to each other through a pin.

12. The fixing device according to claim 11, wherein the first linkage of the lever assembly includes teeth and the resistance applier includes a gear that engages the teeth of the first linkage of the lever assembly.

13. The fixing device according to claim 12, wherein the resistance applier further includes a wave washer.

14. The fixing device according to claim 13, wherein the resistance applier further includes:

a male-threaded bolt disposed opposite a front face of the pressing frame and supporting the gear and the wave washer; and a female-threaded nut disposed opposite a back face of the pressing frame and engaging the male-threaded bolt.

15. The fixing device according to claim 10, further comprising a separator mounted on the pressing frame and contacting the resistance applier, the separator through which the resistance applier moves to separate from the lever assembly when the lever assembly moves the pressing rotary body from the enhanced pressure position to the reduced pressure position.

16. The fixing device according to claim 15, wherein the separator includes:

a through-hole penetrating through the pressing frame, in which the resistance applier moves; and a biasing member contacting the resistance applier to exert a bias that presses the resistance applier against the lever assembly so that the resistance applier exerts drag on the lever assembly.

17. The fixing device according to claim 16, wherein the biasing member includes a torsion spring.

18. The fixing device according to claim 9, wherein the lever assembly is swingable to move the pressing rotary body to a third position different from the reduced pressure position and the enhanced pressure position.

19. The fixing device according to claim 9, wherein the fixing rotary body includes a fixing roller, the pressing rotary body includes a pressing roller, and the resilient member includes a spring.

20. An image forming apparatus comprising the fixing device according to claim 9.

* * * * *